US005261190A

United States Patent [19]

Berger et al.

[11] Patent Number: 5,261,190

[45] Date of Patent: Nov. 16, 1993

[54] ECCENTRIC GRINDER

[75] Inventors: Günther Berger, Notzingen; Karl-Heinz Braunbach, Hornbach, both of Fed. Rep. of Germany

[73] Assignee: Robert Bosch GmbH, Stuttgart, Fed. Rep. of Germany

[21] Appl. No.: 752,440

[22] PCT Filed: Nov. 17, 1989

[86] PCT No.: PCT/DE89/00732

§ 371 Date: Aug. 15, 1991

§ 102(e) Date: Aug. 15, 1991

[87] PCT Pub. No.: WO90/09869

PCT Pub. Date: Sep. 7, 1990

[30] Foreign Application Priority Data

Mar. 2, 1989 [DE] Fed. Rep. of Germany ..... 3906549

[51] Int. Cl.[5] ..... B24B 23/00

[52] U.S. Cl. ..... 51/170 MT; 51/119

[58] Field of Search ..... 51/170 R, 170 MT, 119, 51/120

[56] References Cited

U.S. PATENT DOCUMENTS 3,287,859 11/1966 Leveque ..... 51/170 MT
4,754,575 7/1988 Schneider ..... 51/170 MT
4,759,152 7/1988 Berger et al. ..... 51/170 MT

FOREIGN PATENT DOCUMENTS 3625535 2/1988 Fed. Rep. of Germany .... 51/170 R
0150964 11/1980 Japan ..... 51/170 MT
8804218 6/1988 PCT Int'l Appl. ..... 51/170 MT

*Primary Examiner*—Roscoe V. Parker
*Attorney, Agent, or Firm*—Michael J. Striker

[57] ABSTRACT

An eccentric grinder has a housing provided with a gear rim an eccentrically rotating grinding disc provided with a gear rim which rolls on the gear rim of the housing and in operation without load provides an additional rotary movement of the grinding disc. The gear rim of the grinding disc is a friction rim so that in operation without load there is a minimum slippage and in operation under load there is a maximum slippage of the rims relative to one another. The gear rim of the housing is fixed to the housing and includes a toothed rim which is formed by a ring-shaped toothed belt with a toothing while the gear rim of the grinding disc has a plurality of projections which incompletely engage in the toothing of the gear rim of the housing and therefore an elastic deformation of the projections gives the grinding disc a shaking movement with partial meshing under maximum slippage.

9 Claims, 5 Drawing Sheets

ECCENTRIC GRINDER

BACKGROUND OF THE INVENTION

The invention relates to an eccentric grinder. More particularly it relates to an eccentric grinder which has an eccentrically circulating grinding disc with a gear rim rolling on another gear ring. Such an eccentric grinder is disclosed in DE PS 36 25 655. In the very fine grinding stage, this grinder is safe-guarded against an undesirable increase of the rotary speed of the grinding disc to the idling speed of the machine. This safeguard has been designed in the form of a friction brake, which however requires a considerable number of individual parts and elaborate assembly work. The friction brake is prone to problems and is sensitive to dust. A major effort in sealing technology has therefore to be made. The reliability of the brake diminishes as the wear of its individual parts, such as springs and brake linings, increases. Their repair requires substantial costs. In the harsh industrial operating environment, the known eccentric grinder has the following further disadvantages: The teeth of the eccentric gear are subject to high wear due to the effect of grinding dust. The change-over gear for the additional grinding stage for producing a medium coarseness requires complicated means of setting, which are susceptible to trouble and are lacking in stability. Any careless operation of the gear changes poses the risk of breaking the eccentric gear teeth.

SUMMARY OF THE INVENTION

Accordingly, it is an object of the present invention to provide an eccentric grinder which avoids the disadvantages of the prior art.

In keeping with these objects and with others which will become apparent hereinafter, one feature of the present invention resides, briefly stated, in an eccentric grinder in which a gear rim supported by a grinding disc is formed as a friction rim, a gear rim on which the first mentioned gear rim rolls is fixed on a housing and formed as a toothed rim, and the rims are frictionally engaged so that in operation without loads there is minimum slippage and in operation under load there is maximum slippage.

The eccentric grinder with the characteristic features of the present invention has the advantage of providing high grinding output with a simple space-saving set-up. The eccentric gear teeth are highly resistant to mechanical wear, and the life of the gearing is substantially increased. The hazardous overspeeding of the grinding disc at idling speed is eliminated in a particularly simple manner.

A further modification of the eccentric grinder has in addition the known operating modes, for coarse and medium grinding which are implemented in a simple, careful way by changing the different eccentric rims supported by the grinding disc.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENT

Figure 1:
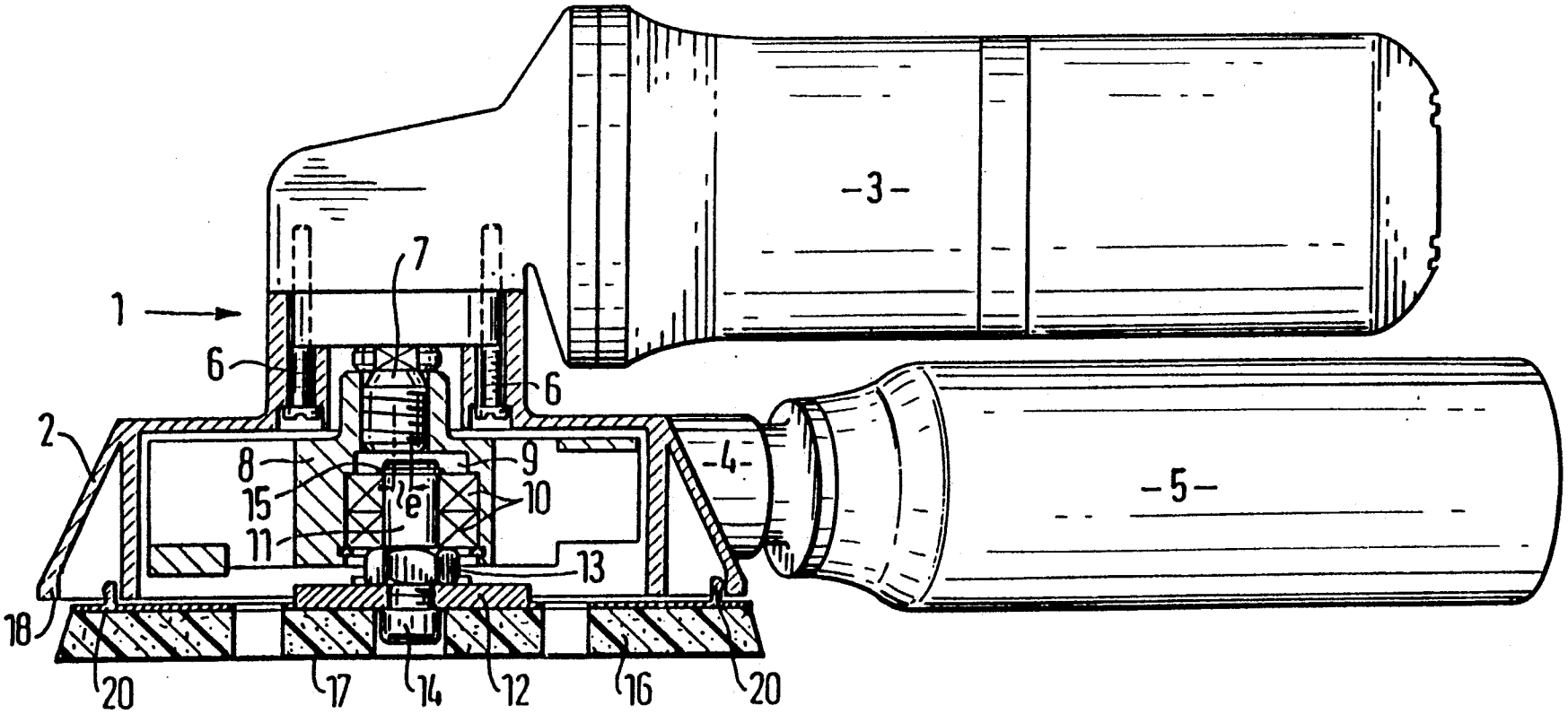
FIG. 1 shows a sectional view of an eccentric grinder.

The eccentric grinder shown in FIG. 1 has a housing for a grinding disc drive, and a drive housing 3. The housing 2 is provided with a connecting piece 4 for the connection of a suction device 5 and is connected to the drive housing by means of screws 6. A drive shaft 7 projects from the drive housing 3. An intermediate piece 8 is screwed onto this. The intermediate piece 8 is designed as a crank and has a counterbore which is offset relative to the drive shaft 7. The eccentricity, i.e. the distance between the axle of the drive shaft 7 and the axle of the counterbore 9 is marked e. Two ball bearings 10 are inserted into the counterbore 9 and locate a support gudgeon 11 for a grinding disc 12. The support gudgeon 11 has a hexagonal piece 13 and a threaded hole at its free end into which a hexagon socket screw can be inserted. The hexagon piece 13 and a retaining washer 15 secure the support gudgeon 11 against axial displacement in the ball races 10. The grinding disc 12 is connected with the support gudgeon 11 via the hexagon socket screw 14. This disc supports a lining 16 with, for example, 4 Velcro type connection, which is used to locate an appropriately shaped abrasive disc 17.

On the eccentric drive housing 2, a gear rim 18 is fixedly arranged. It is designed as an internal ring gear which is concentric in relation to the drive shaft 7. On its front face which faces the housing 2, the grinding disc 12 carries a detachable eccentric gear rim 20 which is torsionally stiff. The gear rim 20 is designed as an external friction rim, which is concentric in relation to the support gudgeon axis 11, and thus is offset in relation to the drive shaft 7. A non-positive connection for the transmission of a rotational movement exists between the gear rim 20 of the grinding disc 12 and the gear rim 18 of the eccentric drive housing 2.

The eccentric grinder operates as follows: A motor which is not shown, drives the drive shaft 7. The drive shaft turns the intermediate piece 8 and allows the support gudgeon 11, which is held eccentrically within the same, and the grinding disc 12 to revolve around the axis of the drive shaft 7. Due to the freely rotatable bearing of the support gudgeon 11, the grinding disc 12 which is fixed to the same, is also freely rotatable. With the grinding disc 12 clear of the surface to be ground, the grinding disc 12 arranged on the support gudgeon 11 rolls with its gear rim 20 with mimimum slippage in the gear rim 18 arranged torsionally fixed on the eccentric housing 2 and forces an additional rotary movement of the grinding disc 12.

With a grinding disc 12 placed on a surface to be ground, the friction between the grinding disc and the surface is so high that maximum slippage occurs between the gear rim 20 and the gear rim 18, so that the grinding disc 12 rotates very slightly, or not at all. The path of each individual abrasive grain per revolution of the eccentric part which, just like the grinding disc 12 makes circular movements with the radius of the eccentricity e, is thus smaller than with an additional forced rotation. Due to the small amount of stock being removed, this results in a finely ground finish.

Figure 2:
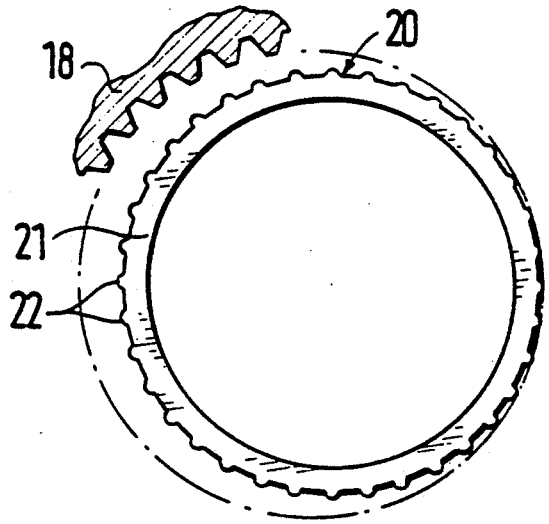
FIG. 2 shows a grinding disc with an eccentric gear with a ring-shaped friction lining.

FIG. 2 shows a gear rim 20 of the grinding disc 12 in joint action with the gear rim 18. The gear rim 20 is provided with a flexible, ring-type friction lining 21 with elastic spikes 22.

Figure 3:
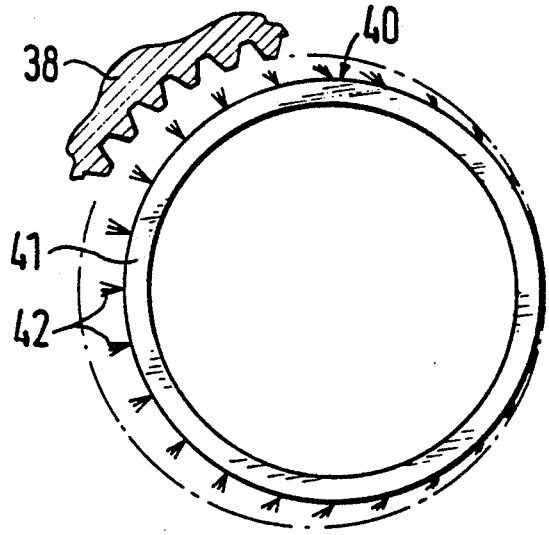
FIG. 3 shows a grinding disc with an eccentric gear with a bristle studded friction lining.

FIG. 3 shows the gear rim 40 with a friction lining 41, furnished with bristles 42 which effect an increased frictional engagement with the gear rim 38 fixed to the housing. This engagement however is restricted by the flexible bending of the bristles 42 and subsequent overlocking.

In the embodiments of FIGS. 2 and 3, as in FIG. 1, the gear rim 20, 40 is dimensioned so that with light pressure of the grinding disc 12 onto a surface to be ground, with for example the own weight of the eccentric grinder 1, no forced rolling movement of the gear rim 20, 40 on the gear rim 18, 38 can take place, but the grinding disc 12 circulates eccentrically with the gear rim 20, 40 without rotating. When the eccentric grinder 1 is operated without load, e.g. when the grinding disc 12 is lifted off the surface to be ground, the friction between the gear rim 20, 40 and the gear rim 18, 38 fixed to the housing, is sufficient to force the grinding disc 12 to rotate at a ratio of approximately 1:60 in relation to the drive shaft 7. An undesired rotary speed increase of the grinding disc 12 to the idling speed of the drive shaft 7 or the support gudgeon 11, due to the bearing friction of the ball race 10, is thus excluded. Otherwise, any increase in speed of the grinding disc 12 would, on contact with the workpiece, effect unintended coarse grinding until the rotation of the grinding disc 12 stopped completely. This would result in damage to finely ground faces and in complaints.

Figure 4:
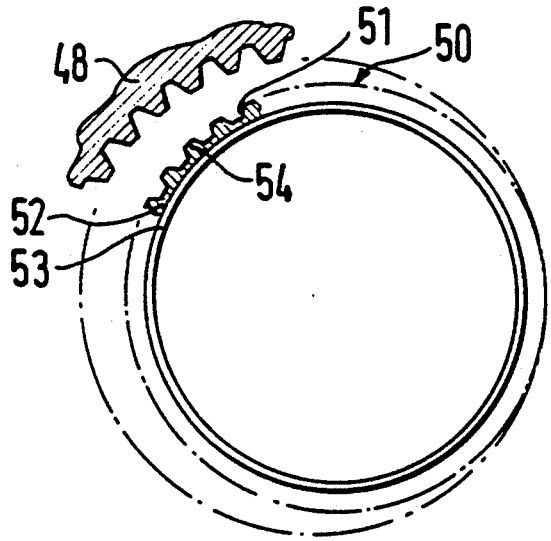
FIG. 4 shows a grinding disc with a toothed eccentric gear consisting of a toothed belt with a rim-like support collar.

In the variant shown in FIG. 4, the gear rim is a toothed part 51. It is formed from a ring-type toothed belt 52. The toothed parts, rests on a rim-type support collar 53 for at least a part of its width. The support collar 53 supports the flexible, soft, ring-type toothed belt 52 which can thus act as a firm friction wheel. Its teeth 54 rub against the gear rim 48 without meshing. Even an additional use of both the toothed sides and the backing of the toothed belt 52 has proved advantageous.

For a further developed eccentric grinder, a coarse grinding stage can be implemented by using a grinding disc, not shown, with an inner toothed rim which engages with an additional, not illustrated, outer toothed rim fixed to the housing. With a similar gear which reverses the movement, a medium grinding stage can be implemented in the familiar manner. A changeover between coarse, medium and fine grinding operation is facilitated by changing the grinding discs with appropriate rolling rims. Here again, the invention can be used to good advantage for the fine grinding stage.

A particularly advantageous variant is obtained for the invention if the gear rim 20, 40, 50 is part of a reversing wheel, so that, for example, a toothed belt is arranged on one side, and a friction ring in the form of an elastic ring is arranged on the other side. By turning the reversing wheel, with the grinding disc 12 removed, it is easy to select between the known operating modes.

Figure 5:
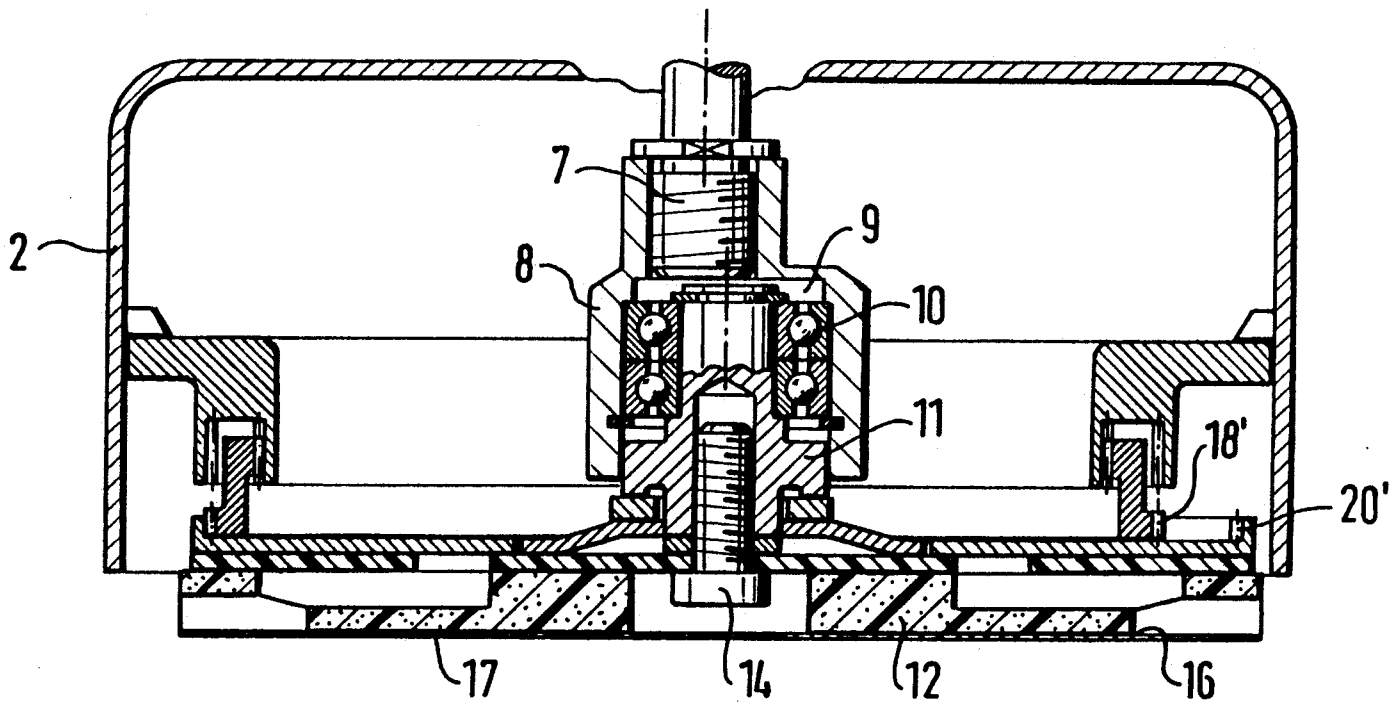
FIGS. 5, 6 and 7 are views showing further modifications of the eccentric grinder in accordance with the present invention.

FIG. 5 shows another modification of the present invention. Here the grinding disc 12 carries a gear rime 20' with inner teeth. The housing has a main part having a recess provided with two groups of teeth, and an additional rime 18' which is also provided with two groups of teeth. The lower teeth of the gear rim 18' engages with the inner teeth of the gear rim 20 of the grinding disc. The upper teeth of the gear rim 18' engage with one group of teeth in the recess of the housing.

Figure 6:
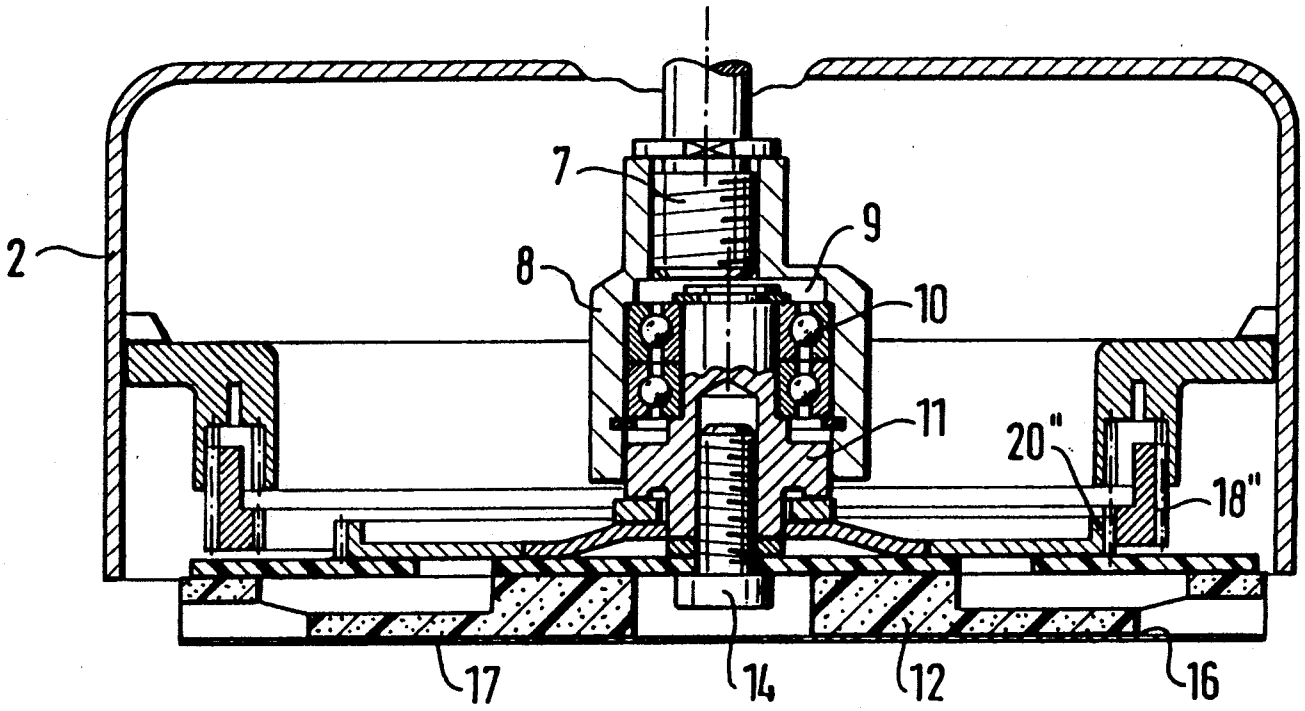

In the embodiment of FIG. 6 the grinding disc 12 carries a gear rim 20" which has outer teeth corresponding to inner teeth of an additional rim 18". The main part of the housing is again provided with a recess having two groups of teeth. In the embodiment of FIG. 6 the outer teeth of the separate rim 18" engage with one group of teeth of the housing. The rims 18' and 20' of the embodiment of FIG. 5 can be exchanged by the rims 18" and 20" of the embodiment of FIG. 6.

Figure 7:
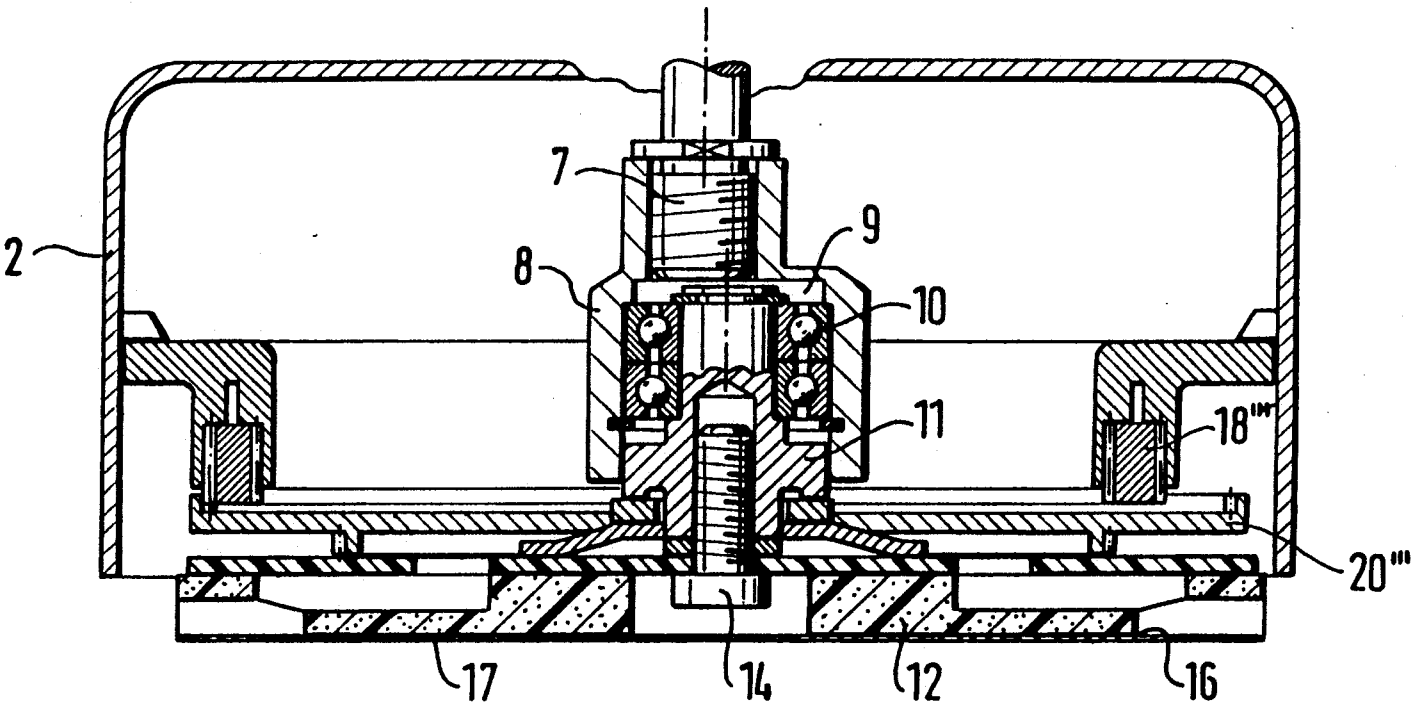

In the embodiment of FIG. 7 the grinding disc 12 carries a reversing gear rim 20''' which has inner teeth arranged on a greater radius and outer teeth arranged on the smaller radius on respective axially extending projections of the rim 20". The housing again has a recess with two groups of teeth. The gear rim 20" is a reversing gear rim, since the inner teeth or the outer teeth of the gear rim 20" can engage with the gear teeth of the housing in a respective position of the gear rim relative to the housing. In particular, in the shown illustration the inner gears of the gear rim 20" engage the gear rim of the housing. When the gear rim 20" engaged the gear rim of the housing. When the gear rim 20" is turned upside down, its outer teeth will engage the teeth of the housing.

With appropriate design, e.g. where force is transmitted through positive interlocking, gears, in accordance with the invention, in particular toothed wheels formed from toothed belts, are suitable for the transmission of higher torques, i.e. for a forced rotation of the grinding disc, with high contact pressure applied to the faces to be ground.

It will be understood that each of the elements described above, or two or more together, may also find a useful application in other types of constructions differing from the types described above.

While the invention has been illustrated and described as embodied in an eccentric grinder, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. An eccentric grinder, comprising a housing provided with a gear rim; an eccentrically rotating grinding disc provided with a gear rim which rolls on said gear rim of said housing and in operation without load provides an additional rotary movement of said grinding disc, said gear rim of said grinding disc being a friction rim so that in operation without load there is a minimum slippage and in operation under load there is a maximum slippage of said rims relative to one another, said gear rim of said housing being fixed to said housing and includes a toothed rim which is formed by a ring-shaped toothed belt with a toothing while said gear rim of said grinding disc has a plurality of flexible projections which incompletely engage in said toothing of said gear rim of said housing and therefore an elastic deformation of said flexible projections gives said grinding disc a shaking movement with partial meshing under maximum slippage.

2. An eccentric grinder as defined in claim 1, wherein said gear rim of said grinding disc includes a rim-type support collar and a ring-type toothed belt held on said rim-type support collar.

3. An eccentric grinder as defined in claim 1; and further comprising a friction lining supported on said gear rim of said grinding disc.

4. An eccentric grinder as defined in claim 3, wherein said friction lining of said gear rim is formed as an elastic ring.

5. An eccentric grinder as defined in claim 3, wherein said friction lining is provided with a plurality of elastic spikes which form said projections.

6. An eccentric grinder as defined in claim 3, wherein said friction lining is provided with a plurality of bristles which form said projections.

7. An eccentric grinder as defined in claim 1, wherein said gear rims are composed of toothed belts and formed as friction rims.

8. An eccentric grinder as defined in claim 1; and further comprising a further gear rim provided on said housing and formed so that when said grinding disc is removed a further grinding disc provided with a further gear rim different from said first mentioned gear rim of said first mentioned grinding disc can be mounted and said further gear rim provided on said housing engages with said further gear rim of said further grinding disc.

9. An eccentric grinder as defined claim 1; and further comprising reversing wheels, said gear rims being arranged on said reversing wheels on both sides.

* * * * *